United States Patent [19]

Parlman et al.

[11] 4,439,314

[45] Mar. 27, 1984

[54] FLOTATION REAGENTS

[75] Inventors: Robert M. Parlman; Clarence R. Bresson, both of Bartlesville, Okla.

[73] Assignee: Phillips Petroleum Company, Bartlesville, Okla.

[21] Appl. No.: 406,156

[22] Filed: Aug. 9, 1982

[51] Int. Cl.[3] ..... B03D 1/14

[52] U.S. Cl. ..... 209/166; 209/167; 252/61

[58] Field of Search ..... 209/166, 167; 252/61

[56] References Cited

U.S. PATENT DOCUMENTS

| | | | |
|---|---|---|---|
| 3,595,390 | 7/1971 | Booth | 209/166 |
| 4,211,644 | 7/1980 | Wiechers | 209/166 |

FOREIGN PATENT DOCUMENTS

| | | | |
|---|---|---|---|
| 939835 | 1/1974 | Canada | 209/166 |
| 74/4540 | 2/1976 | South Africa . | |
| 365915 | 1/1932 | United Kingdom | 209/166 |

*Primary Examiner*—Bernard Nozick

[57] ABSTRACT

A blend of certain xanthates with mercaptan/glycol combinations produce collector compositions which yield improved results in ore flotation.

7 Claims, No Drawings

FLOTATION REAGENTS

BACKGROUND OF THE INVENTION

This invention relates to flotation processes for recovering minerals from their ores. In one aspect of the invention it relates to the recovery of molybdenum-, iron-, and copper-bearing minerals from their ores. In another aspect of the invention it relates to the use of flotation collectors and flotation depressants in the recovery of minerals from their ores.

Froth flotation is a process for concentrating minerals from ores. In a froth flotation process, the ore is crushed and wet ground to obtain a pulp. Additives such as mineral flotation or collecting agents and frothing agents are added to the pulp to assist in subsequent flotation steps in separating valuable minerals from the undesired portions of the ore. The pulp is then aerated to produce a froth at the surface. The minerals which adhere to the bubbles or froth are skimmed or otherwise removed and the mineral-bearing froth is collected and further processed to obtain the desired minerals. Frequently, other chemicals are added to the separated mineral-bearing froth to assist in subsequent separations particularly when significant proportions of two or more minerals are present in the separated mineral-bearing froth.

THE INVENTION

In accordance with this invention, froth flotation separations of ores into copper-, iron-, and molybdenum-bearing components can be improved by the use of novel combinations of xanthates, mercaptans and polyalkylene glycols. In the process of the invention a metallurgical ore is contacted, during a froth flotation operation, with the reagent combination described herein in an amount sufficient to assist the collection of copper, iron, and molybdenum compounds.

OBJECTS OF THE INVENTION

It is one object of the invention to provide a composition containing a combination of compounds, which composition is useful as a collector and frother for the separation of copper-, iron-, and molybdenum-bearing minerals from ores containing them.

It is another object of the invention to provide a process for separating ores such that copper-, iron-, and molybdenum-containing compounds can be recovered therefrom.

Other aspects and objects of this invention will become apparent upon reading this specification and the appended claims.

ADVANTAGES OF THE INVENTION

The flotation or collecting agents which result from the combination of certain xanthates, mercaptans, and polyalkylene glycols in accordance with the invention are superior to any of these reagents taken alone in that significant improvements in minerals recovery are attained using the compositions and process of this invention.

DESCRIPTION OF THE INVENTION

The compositions used as collectors and frothers in this invention contain at least one compound or compound admixture from each of two categories.

The first category comprises metal xanthates of the general formula $$R^1-O-\overset{\overset{\displaystyle S}{\|}}{C}-S-M \qquad \text{(I)}$$

where $R^1$ is an alkyl group containing from 1 to about 10 carbon atoms, and M is a Group IA metal. Useful compounds in this category include potassium n-butyl xanthate, lithium ethyl xanthate, sodium isopropyl xanthate, sodium ethyl xanthate, and the like. Compounds in which M is sodium are preferred. Sodium isopropyl xanthate is highly preferred. Mixtures of these compounds are operable.

The amount of metal xanthate employed will generally be from 0.001 to 0.2 lbs/ton ore, with 0.005 to 0.05 lbs/ton preferred.

The second category comprises mixtures of mercaptans and polyalkylene glycols. The mercaptan component(s) will be one or more alkanethiol collectors represented by the formula $C_nH_{2n+1}SH$ (II) wherein n can be any integer from about 6 to about 17. Representative alkanethiols are, but are not limited to, for example, 1-hexanethiol, 1-octanethiol, 1-nonanethiol, 1-decanethiol, 1-undecanethiol, 1-dodecanethiol (n-dodecylmercaptan), 1-tetradecanethiol, and 1-heptadecanethiol; 2-hexanethiol, 2-nonanethiol, 2-decanethiol, 2-undecanethiol, 2-dodecanethiol (sec-dodecylmercaptan), 2-heptadecanethiol, 3-nonanethiol, 3-dodecanethiol, and 3-heptadecanethiol; 2-methyl-2-octanethiol, 3-methyl-3-octanethiol, 4-ethyl-4-heptanethiol, 2-methyl-2-undecanethiol, 3-methyl-3-undecanethiol, 4-ethyl-4-decanethiol, 5-ethyl-5-decanethiol, 2,4,6-trimethyl-4-nonanethiol, 3-n-propyl-3-tetradecanethiol, and 2,4,6,8,10-pentamethyl-2-dodecanethiol. The twelve carbon tert-alkanethiols generally are present in a mixture of isomers and are commonly referred to as tert-dodecylmercaptan. Saturated aliphatic mercaptans, such as n-dodecylmercaptan, are one preferred group of collectors.

The amount of alkanethiol employed will generally be from about 0.005 lbs/ton to about 0.5 lbs/ton of ore.

The polyalkylene glycols useful herein and referred to as wetting agents, or disperants are represented by the formula $$HO\text{-}(R^2-O)_x\text{-}R^3 \qquad \text{(III)}$$

in which $R^2$ is a branched or straight chain alkylene radical of about 3 to about 5 carbon atoms with the proviso that at least two carbon atoms separate the oxygen atoms, $R^3$ is hydrogen, methyl or ethyl, and x is an integer from about 6 to about 17. In a preferred embodiment, $R^2$ is $-CHR^4CH_2-$ in which $R^4$ is methyl, ethyl, or propyl. Typical compounds are, but are not limited to, such materials as poly(propylene glycol) 250*
poly(propylene glycol) 400*
poly(propylene glycol) 425*
poly(propylene glycol) 750*
poly(propylene glycol) 900*
poly(butylene glycol)
poly(pentylene glycol)

*average molecular weight along with the corresponding monomethyl and monoethyl ethers and the like. Mixtures of glycols/ethers are operable. The molecular weight of these glycols and ethers will generally lie above 365, and can be broadly from about 365 to about 1000. The preferred molecular weight range is from about 425 to about 772.

The amount of dispersant employed will generally depend on the amount of mercaptan collector employed. Usually the weight ratio of collecting agent to dispersant will be from about 6:1 to 2:1. The collector and dispersant can be added separately during the froth flotation, although if compatible they can be premixed or emulsified together before using.

Some metal-bearing ores within the scope of this invention are, but are not limited to, such materials as

| | | |
|---|---|---|
| Molybdenum-Bearing Ores | Molybdenite | $MoS_2$ |
| | Wulfenite | $PbMoO_4$ |
| | Powellite | $Ca(Mo, W)O_4$ |
| | Ferrimolybdite | $Fe_2Mo_3O_{12}.8H_2O$ |
| Copper-Bearing Ores | Covallite | CuS |
| | Chalcocite | $Cu_2S$ |
| | Chalcopyrite | $CuFeS_2$ |
| | Bornite | $Cu_5FeS_4$ |
| | Cubanite | $Cu_2SFe_4S_5$ |
| | Valerite | $Cu_2Fe_4S_7$ or $Cu_3Fe_4S_7$ |
| | Enargite | $Cu_3(As, Sb)S_4$ |
| | Tetrahedrite | $Cu_3SbS_2$ |
| | Tennamite | $Cu_{12}As_4S_{13}$ |
| | Cuprite | $Cu_2O$ |
| | Tenorite | CuO |
| | Malachite | $Cu_2(OH)_2CO_3$ |
| | Azurite | $Cu_3(OH)_2CO_3$ |
| | Antlerite | $Cu_3SO_4(OH)_4$ |
| | Brochantite | $Cu_4(OH)_6SO_4$ |
| | Atacamite | $Cu_2Cl(OH)_3$ |
| | Chrysocolla | $CuSiO_8$ |
| | Famatinite | $Cu_3(Sb, As)S_4$ |
| | Bournonite | $PbCuSbS_3$ |
| Iron-Bearing Ores | Pyrite | $FeS_2$ |
| | Pyrrhotite | $Fe_5S_6$ to $Fe_{16}S_{17}$ |
| | Pentlandite | (Fe, Ni)S |

The sequence in which these reagents are contacted with an ore or minerals concentrate is critical. The xanthate and the mercaptan/dispersant combination must be added at the same point in the process.

The amount in which the compounds from each category are used can be varied. Often, the amounts employed are based on such considerations as the type of flotation apparatus, the nature and amount of the frother used, the type of mineral being floated, the temperature, and the pH of the system. Generally, the amount of reagent(s) used from each of the two categories will be such that, when admixed, the resultant combination will be an effective collecting agent for the copper-, iron-, and molybdenum-containing substances in the ore. One skilled in the art can devise suitable quantities of each type of reagent to be employed in the blends of the invention.

Any froth flotation apparatus can be used in this invention. The most commonly used commercial flotation machines are the Agitair (Galigher Co.), Denver Sub-A (Denver Equipment Co.), and the Fagergren (Western Machinery Co.). Smaller, laboratory scale apparatuses such as the Denver D-2 or Wemco cell can also be used.

The instant invention was demonstrated in tests conducted at ambient room temperature and atmospheric pressure. However, any temperature or pressure generally employed by those skilled in the art is within the scope of this invention.

The following examples serve to illustrate the operability of this invention.

EXAMPLE I

This example is a control that demonstrates a typical procedure used to evaluate the mineral collector systems described herein and also demonstrates the effectiveness of a known collector system in floating copper from gangue material. A typical standard laboratory batch flotation test is conducted by grinding a 1000 gram sample of preground ore (about −10 mesh) containing 0.40 weight percent copper and 0.015 weight percent molybdenum sulfide (Phelps Dodge Corp., Metcalf Div., Morenci Ariz.) in a lab rod mill at a 70 weight percent aqueous level and enough lime (0.5 grams) added to obtain a pH of 10.5 during flotation. In addition to the ore, water and lime, there was added before the grind 0.03 pounds per ton of sodium diethyl dithiophosphate (Sodium Aerofloat) and 0.01 pounds per ton of alkyl amyl xanthate (AC 3302). After about 4.5 minutes of grind, the mixture was transferred to a Denver D-12 flotation cell along with enough water to give a 35 weight percent aqueous solution and the pH measured. Also added to the cell was 0.05 pounds per ton of Dow 250 frother (a polypropy-lene glycol mono methyl ether, MW 250) and the agitator turned on at about 800 rpm. The contents were conditioned for one minute and then floated for 4 minutes, the concentrate being skimmed off with a paddle once around the cell every 10 seconds. After the float, 0.01 pounds per ton of sodium isopropyl xanthate (Z-11) was added and the cell contents again floated for another 4 minutes. Occasionally, reagents, particularly collectors, are added intermittently or more than one float is carried out. After flotation, the concentrate is dried and analyzed. In this manner, the control collector system using sodium isopropyl xanthate was evaluated, three runs were conducted and the results are shown in Table I.

Occasionally, reagents, particularly collectors, are added intermittently, or more than one float period is carried out. After flotation, the concentrate is dried and analyzed. In this manner the control collector system using sodium isopropyl xanthate was evaluated, three runs were conducted and the results are shown in Table I.

TABLE I

Effect of Collector on Copper Recovery (Denver Lab Cell) (1000 gram Ore Sample)

Collector: 0.008 lbs/ton Sodium Isopropyl Xanthate (Z-11)

| | Rougher Conc. | | Tails | | |
|---|---|---|---|---|---|
| Run No. | Grams | % Cu | Grams | % Cu | % Cu Recovery |
| 1 | 67.5 | 4.74 | 944.8 | .086 | 80.1 |
| 2 | 80.7 | 3.73 | 913.6 | .067 | 83.0 |
| 3 | 93.1 | 3.50 | 899.9 | .075 | 82.8 |
| | | | | | Average: 82.0% |

EXAMPLE II

This example is a control illustrating the effect on copper recovery when the sodium isopropyl xanthate is replaced with mercaptan-based collector. The procedure described in Example I was repeated except sodium isopropyl xanthate (Z-11) was replaced with an n-dodecyl mercaptan/polypropylene glycol mixture. The results which are shown in Table II indicate a slight improvement on the percent copper recovered.

TABLE II (1000 gram Ore Sample)
collector: .008 lbs/ton n-Dodecyl Mercaptan (80 wt. %)-Polypropylene Glycol-MW450 (20 wt. %)

| Run No. | Rougher Conc. grams | Rougher Conc. % Cu | Tails grams | Tails % Cu | % Cu Recovery |
|---|---|---|---|---|---|
| 1 | 85.4 | 3.87 | 910.9 | .075 | 82.9 |
| 2 | 85.8 | 3.73 | 907.8 | .070 | 83.4 |
| | | | | | average 83.1% |

EXAMPLE III

This example is the invention illustrating that combining the collectors sodium isopropyl xanthate and the n-dodecyl mercaptan/polypropylene glycol blend from Examples I and II gives improved copper recovery. The procedure described in Example I was repeated except about 0.01 lbs/ton of the n-dodecyl mercaptan/-polypropylene glycol-MW450 mixture was added together with the sodium isopropyl xanthate collector. The results listed in Table III show improved copper recovery.

TABLE III (1000 gram Ore Sample)
Collector: 0.008 lbs/ton Sodium Isopropyl Xanthate (Z-11)
0.01 lbs/ton n-Dodecyl Mercaptan (80 wt. %)-Polypropylene Glycol-MW 450 (20 wt. %)

| Run No. | Rougher Conc. grams | Rougher Conc. % Cu | Tails grams | Tails % Cu | % Cu Recovery |
|---|---|---|---|---|---|
| 1 | 85.6 | 3.65 | 909.6 | .079 | 81.3 |
| 2 | 82.4 | 4.32 | 911.8 | .062 | 86.3 |
| 3 | 85.5 | 3.81 | 904.7 | .036 | 90.9 |
| | | | | | Average 86.3% |

EXAMPLE IV

This example is the invention and demonstrates that the results obtained on a laboratory scale in Example III can be also obtained when applied to plant scale operations. These results are listed in Table IV where it is shown that the percent recovery of copper, iron and molybdenum is enhanced by the addition of the sodium isopropyl xanthate/mercaptan-glycol blend at the same point in the collector system. Portions of most of the ingredients were adjusted so that when the mercaptan-glycol blend was added, the total collector-dispersant-etc. was about the same.

Table IV follows.

TABLE IV

Plant Scale Flotation (42,000 tons/day)

| Run No. | Flotation Agents, lbs/ton Ore: Dow 250[a] | Na Aerofloat[b] | 3302[c] | Z-11[d] | Fuel Oil | NDM[e] | % Recovery: Cu | Fe | Mo |
|---|---|---|---|---|---|---|---|---|---|
| Control | | | | | | | | | |
| 1 | .029 | .014 | .009 | .008 | .009 | — | 63.3 | 16.8 | 23.7 |
| Invention | | | | | | | | | |
| 2 | .022 | .009 | .009 | .004 | .009 | .02 | 65.5 | 18.7 | 28.1 |

[a]A polypropylene glycol mono-methyl ether, MW 250
[b]Sodium diethyl dithiophosphate
[c]Allyl amyl xanthate
[d]Sodium isopropyl xanthate
[e]80 wt. % n-Dodecyl mercaptan/20 wt. % polypropylene glycol, MW 450, added as a scavenger in a secondary float.

Reasonable variations, such as those which would occur to the skilled artisan, may be made herein without departing from the scope of the invention.

We claim:

1. A composition useful in the collection of metal-containing substances via the froth flotation of ores containing then which comprises:
   (a) sodium isopropylxanthate,
   (b) n-dodecylmercaptan, and
   (c) at least one dispersant containing a polyalkylene glycol conforming to the general formula $$HO-(R^2-O)_x-R^3$$

where $R^2$ is a branched or straight chain alkylene radical of about 3 to about 5 carbon atoms with the proviso that at least 2 carbon atoms separate the oxygen atoms, $R^3$ is hydrogen, methyl, or ethyl, and x is an integer from about 6 to about 17.

2. The composition of claim 1 wherein the quantity of (a) is 0.001 to 0.2 pounds per ton, the quantity of (b) is 0.005 to 0.5 pounds per ton, and the weight ratio of (b) to (c) is from about 6:1 to 2:1 based on the weight of the ore present.

3. The composition of claim 2 wherein (c) contains a polyalkylene glycol of the formula $$HO-(CHR^4CH_2-O)_x-R^3$$

wherein $R^4$ is methyl, ethyl, or propyl.

4. The composition of claim 3 wherein the polyalkylene glycol has a molecular weight ranging from about 365 to about 1000.

5. The composition of claim 1 wherein the polyalkylene glycol has a molecular weight of about 450.

6. The composition of claim 2 wherein (c) contains a polypropylene glycol.

7. A process of separating ores into their constituent metal-bearing substances with froth flotation comprising the step of contacting the ore with the composition defined by any one of claims 3, 6 or 1.

* * * * *